United States Patent [19]

Walton

[11] Patent Number: 4,619,454

[45] Date of Patent: Oct. 28, 1986

[54] LEG CONDITIONER FOR LEG SPLIT TYPE EXERCISE

[76] Inventor: Ronald A. Walton, 4207 Byers St., Capitol Heights, Md. 20743

[21] Appl. No.: 739,097

[22] Filed: May 30, 1985

[51] Int. Cl.[4] ..... A63B 21/00

[52] U.S. Cl. ..... 272/141; 272/136

[58] Field of Search ..... 272/136, 141, 134, 144, 272/70, 97, 130, 142, 137, DIG. 10

[56] References Cited

U.S. PATENT DOCUMENTS

| | | | |
|---|---|---|---|
| 3,559,986 | 2/1971 | Ehrmantraut | 272/70 X |
| 3,584,871 | 6/1971 | Kelmon, Jr. et al. . | |
| 3,664,667 | 5/1972 | McCarthy . | |
| 3,749,400 | 7/1973 | Stoffel | 272/134 |
| 3,992,004 | 11/1976 | Feron et al. | 272/141 |
| 4,046,373 | 9/1977 | Kim | 272/63 |
| 4,111,417 | 9/1978 | Gardner | 272/136 |
| 4,132,404 | 1/1979 | Wilson | 272/DIG. 10 X |
| 4,225,132 | 9/1980 | Archambault | 272/137 |
| 4,340,214 | 7/1982 | Schutzer | 272/70 |
| 4,496,147 | 1/1985 | DeCloux et al. | 272/130 |
| 4,531,730 | 7/1985 | Chenera | 272/144 |

FOREIGN PATENT DOCUMENTS 2631897 1/1978 Fed. Rep. of Germany ..... 272/97

OTHER PUBLICATIONS

Advertisement—Ultra-Stretch, p. 63.
Advertisement—Hurley Stretch-Rack, p. 42.

*Primary Examiner*—Richard J. Apley
*Assistant Examiner*—Robert W. Bahr
*Attorney, Agent, or Firm*—Antonelli, Terry & Wands

[57] ABSTRACT

The leg conditioner comprises an elongated frame, a pair of foot braces which are mounted on the frame for movement toward and away from one another and a pair of handles arranged in spaced relationship between the foot braces on opposite sides of a line extending between the foot braces for a person to grip when performing a leg exercise. Springs or an elastic member are provided to yieldably resist movement of the foot braces away from one another. The leg conditioner permits a person to safely attain and maintain a full or nearly full leg split exercise position and also to safely execute a rocking motion during the exercise to relieve pressure. The efficiency of this type of exercise for leg conditioning is also enhanced by use of the device.

8 Claims, 7 Drawing Figures

LEG CONDITIONER FOR LEG SPLIT TYPE EXERCISE

BACKGROUND OF THE INVENTION

The present invention is directed to a leg conditioner for use by a person performing a leg split type exercise with the legs spread apart and the body in a position above the legs.

Leg exercises of this type are performed by athletes and others for warm-up before an athletic event or for conditioning to improve leg flexibility and strength. For example, dancers may perform such leg exercises to prepare themselves for the full or nearly full leg split feats which they must perform on the dance floor or in mid air during jumps in dance routines. Karate training may also involve this type of leg exercise.

In the past leg split exercises have typically been performed by a person, unaided, standing on a floor or playing field and extending one leg forward and the other backward until the upper body is lowered at least partially toward the playing field or floor to stretch the muscles, tendons and ligaments in the legs. A backward and forward rocking motion of the upper body is used to alternately increase and relieve the pressures on the legs. As the legs are pushed out further forwardly and backwardly from the body, the legs and body approach the playing field or floor in a full or nearly full leg split exercise position.

While these leg exercises are helpful in warming up and conditioning the legs to improve leg flexibility and strength, there are several problems associated with performing the exercises. Namely, as the feet are moved further and further outward from the body it becomes more difficult for a person to maintain balance and keep the body upright, that is above the legs, during the exercise. Maintaining balance becomes even more difficult with the execution of a rocking motion for relieving and increasing the stresses experienced by the legs during the exercise. Loss of balance and falling out of position during the exercise is problematical not only because it interrupts the exercise but also because it can result in an injury due to the fall or due to a sudden strain caused by the loss of balance. The time required for leg conditioning in this manner can be considerable because of the interruptions from loss of balance and falling and because of the limited stresses experienced by the legs during the exercise.

An object of the present invention is to provide a leg exercising device which can be used by a person performing a leg split type exercise with the legs spread apart and the body in a position above the legs so as to avoid the aforementioned disadvantages associated with this type of exercise. More specifically, an object of the invention is to provide a leg conditioner for use by a person performing a leg split type exercise which permits the person to safely perform the exercise without loss of balance and possible injury therefrom.

Another object of the present invention is to provide a leg conditioner for use by a person performing a leg split type exercise which enables the person to more efficiently perform a rocking motion during the exercise to relieve stresses experienced in the legs.

An additional object of the invention is to provide a leg conditioner for use by a person performing a leg split type exercise with the legs apart and the body in an upright position which more efficiently strengthens the legs and improves the flexibility thereof during the exercise as compared with the known leg exercise referred to above.

These and other objects of the invention are attained by providing a leg conditioner for use by a person performing a leg split type exercise with the legs spread apart and the body in a position above the legs comprising a frame, a pair of foot braces, means mounting the foot braces on the frame so that relative movement between the foot braces can be effected by a person performing the exercise with the feet on the respective foot braces, and handle means arranged on the frame between the foot braces for the person to grip when performing the leg exercise.

In a disclosed preferred form of the invention the leg conditioner frame is elongated and the foot braces are mounted on the frame for movement toward and away from one another in a direction along the length of the frame. Further, means are provided for resiliently biasing the foot braces against movement away from one another in order to increase the stresses on the legs required to move the feet apart during the exercise. The means mounting the foot braces on the frame permits the foot braces to be moved away from one another with a person's feet thereon such that the person can assume a full or nearly full leg split exercising position. The handle means comprises a pair of handles arranged in spaced relationship on opposite sides of a line extending between the foot braces to allow a person to grip the handles during the exercise without interfering with the attainment of a full split position on the frame of the leg conditioner. By gripping the handles the person performing the exercise can safely maintain balance and at the same time perform a rapid forward and backward rocking motion to alternately increase and relieve pressures on the legs.

According to one disclosed embodiment of the invention, the means mounting the foot braces on the frame of the leg conditioner includes wheels attached to the foot braces. The wheels cooperate with guides provided on the frame for moving the foot braces on the frame. In another embodiment, the means mounting the foot braces on the frame for movement includes an elongated slot provided in the frame within which the foot rests are slidably mounted.

Resilient biasing of the foot braces against movement away from one another is accomplished according to one embodiment of the invention by providing a pair of springs which respectively bias the foot braces against movement away from one another. In another form of the invention a resilient member is provided which extends between and is connected to the foot braces to bias the foot rests against movement away from one another.

These and other objects, features and advantages of the present invention will become more apparent from the following description when taken in connection with the accompanying drawings which show, for purposes of illustration only, two embodiments in accordance with the present invention.

DETAILED DESCRIPTION OF THE DISCLOSED EMBODIMENTS

Figure 1:
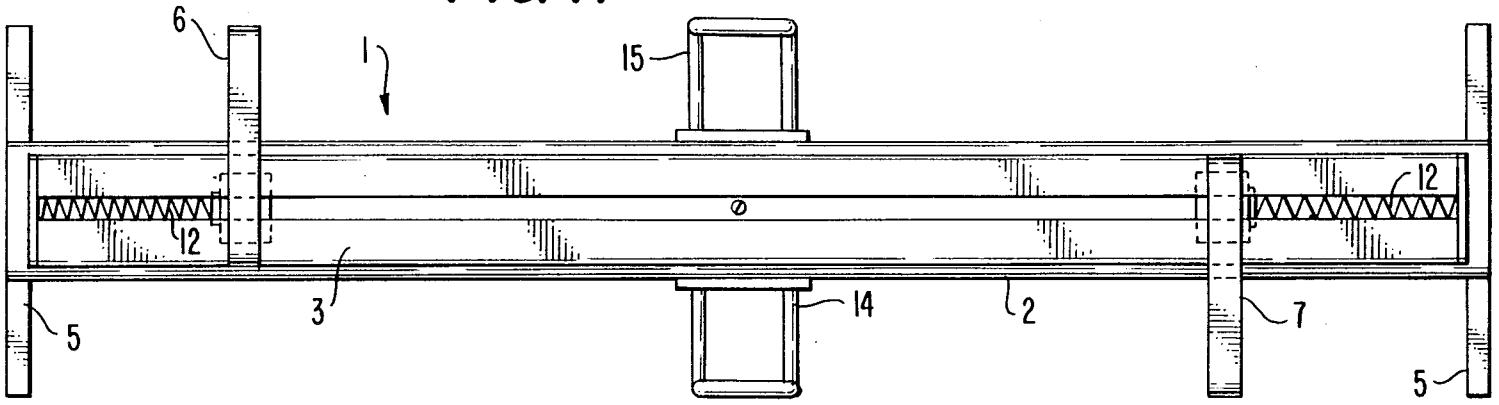
FIG. 1 is a top view of a preferred embodiment of a leg conditioner according to the invention.
Figure 2A:
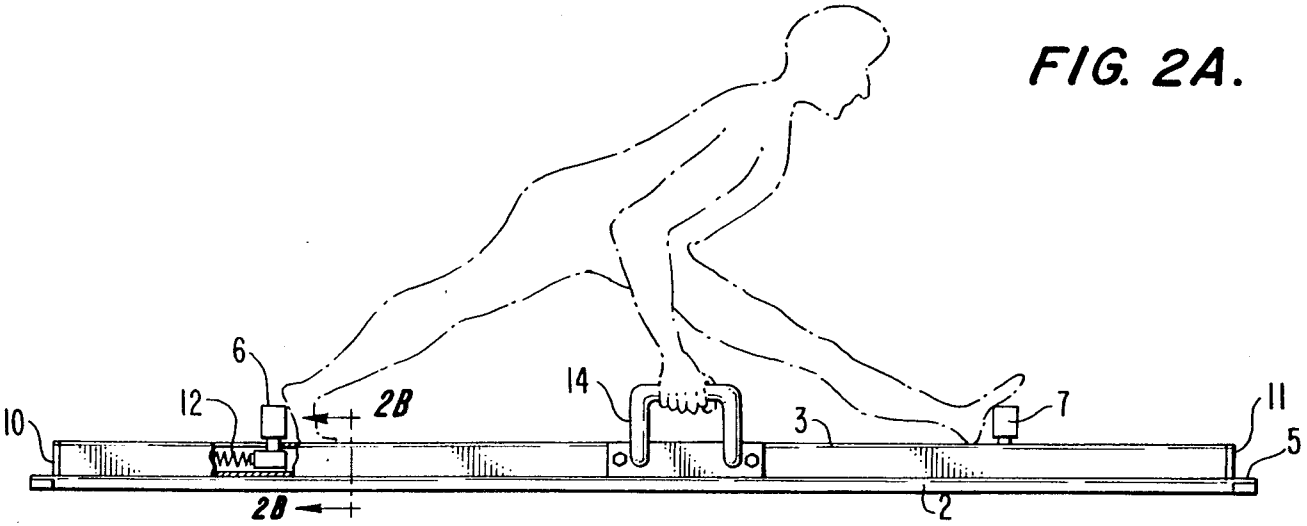
FIG. 2A is a side elevational view of the leg conditioner of FIG. 1 wherein a person performing a leg split type exercise with the leg conditioner is schematically shown in position on the leg conditioner.
Figure 2B:
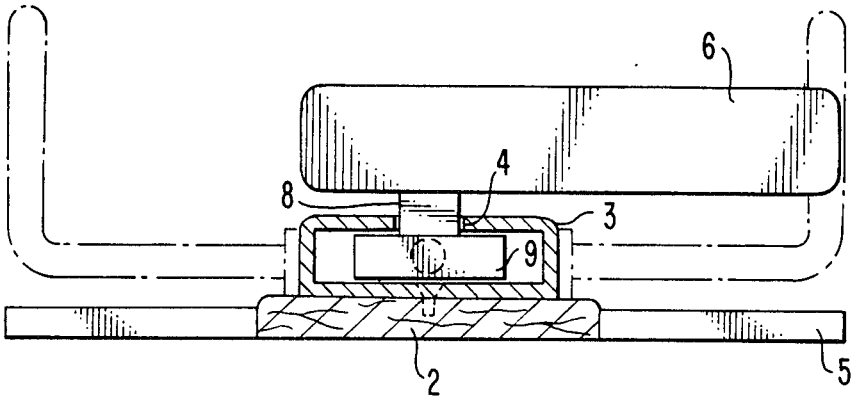
FIG. 2B is a cross sectional view of the device of FIG. 2A taken along the line II—II.
Figure 3:
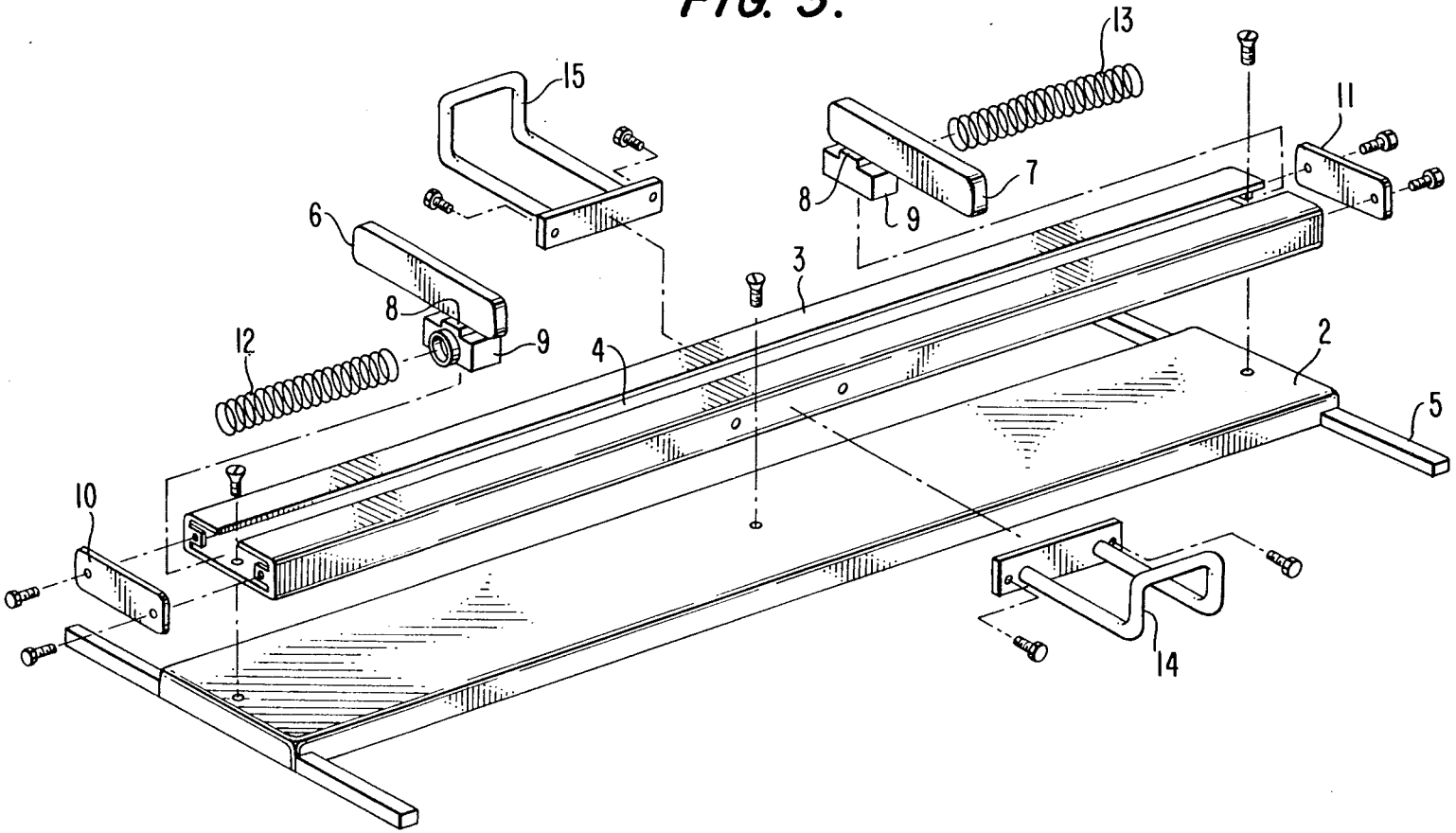
FIG. 3 is a perspective view of the several components of the leg conditioner in a disassembled position to illustrate the respective components thereof.

Referring now to the drawings, as shown in FIGS. 1 through 3, a leg conditioner 1 according to the invention comprises an elongated frame 2 which is preferably formed of metal. The frame includes an elongated tubular member 3 having a slot 4 in its upper surface extending the full length of the tubular member. The member 3 is secured to an elongated base plate 5 by means of fasteners such as bolts and nuts, not shown. Alternately, the tubular member and base plate could be welded or otherwise joined to one another.

A pair of foot braces 6 and 7 are mounted on the tubular member 3 of the frame 2 for movement toward and away from each other. In particular, the foot braces extend outwardly from the tubular member but have a base or stem 8 extending downwardly therefrom through the slot 4. A widened portion or flange 9 is provided at the free end of each stem to prevent the foot braces from being removed from the tubular member through the slot 4 while permitting the foot braces to slide along the length of the frame in the slot 4. End plates 10 and 11 are provided on the tubular member in the assembled condition to retain the foot braces within the slot 4 of the tubular member. A pair of compression springs 12 and 13 are provided to bias the foot braces against movement away from one another. That is, the springs 12 and 13 extend between the flanges 9 of each foot brace and the respective end plates 10 and 11 provided on the tubular member so as to resiliently resist the outward movement of the foot braces by the user during a leg split type exercise. The springs normally bias or position the foot braces toward the center of the elongated frame with the foot braces being moved outwardly in the slot of the frame in response to forces exerted thereon by a person performing a leg exercise with the feet on the respective foot braces. The springs may optionally be connected to the respective foot braces and end plates. The length of the frame is sufficient to allow a person to move the foot braces apart with the feet thereon during a leg exercise so that the person can attain a full or nearly full leg split exercising position as shown in FIG. 2. In this position the user grips a pair of handles 14 and 15 arranged on the frame between the foot braces. The handles 14 and 15 are secured to the side of the tubular member 3 by bolting or otherwise attached thereto as by welding, for example. The handles are arranged in spaced relationship on opposite sides of a line extending between the foot braces so as to be conveniently located for gripping with respective hands while not interfering with the attainment of a full leg split exercise position. That is, the spacing between the handles permits the legs to contact the upper surface of the tubular member 3 of the frame 2 in a full leg split position without interference by the handles. By gripping the handles, a person can vigorously execute a forward and backward rocking motion to alternately increase and relieve pressures on the legs without fear of loss of balance and possible injury. The handles may be formed of metal and covered with a rubber or plastic material to facilitate gripping.

Figure 4:
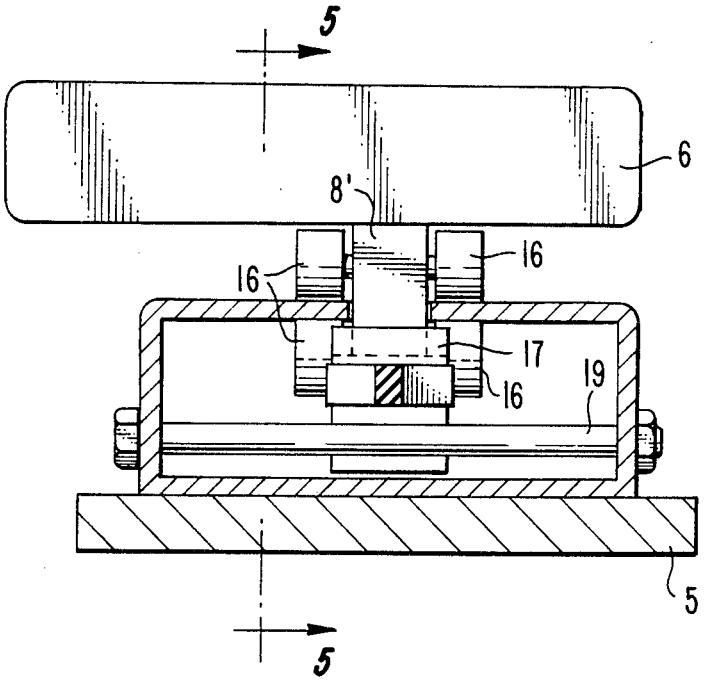
FIG. 4 is an end view, partially in cross section, of another form of the invention wherein the foot braces are mounted on the frame with wheels attached to the foot braces.
Figure 6:
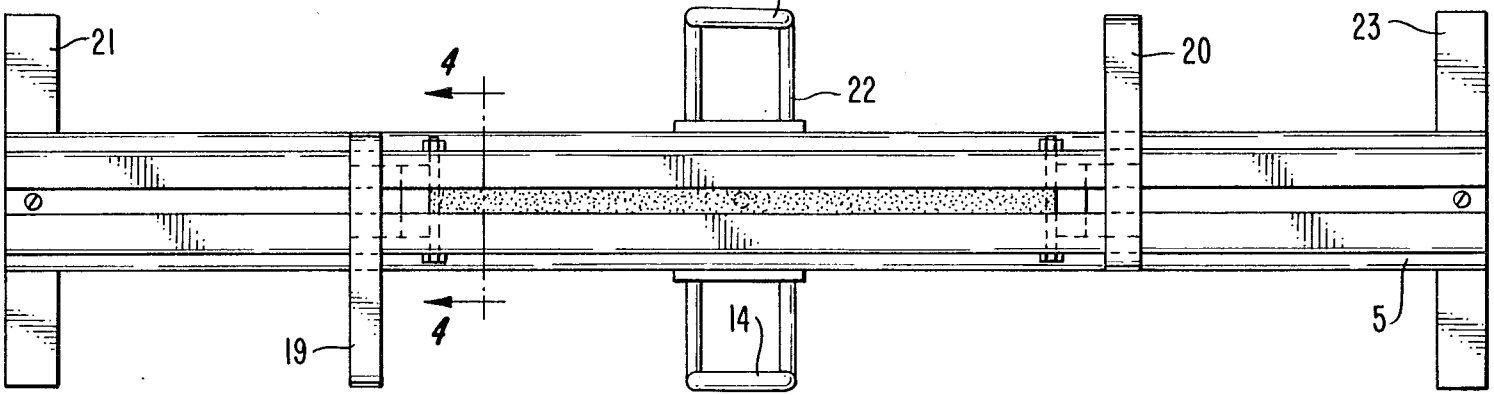
FIG. 6 is a top view of the leg conditioner of FIGS. 4 and 5 and wherein a resilient member extends between and is connected to the foot braces to bias the foot braces against movement away from one another.
Figure 5:
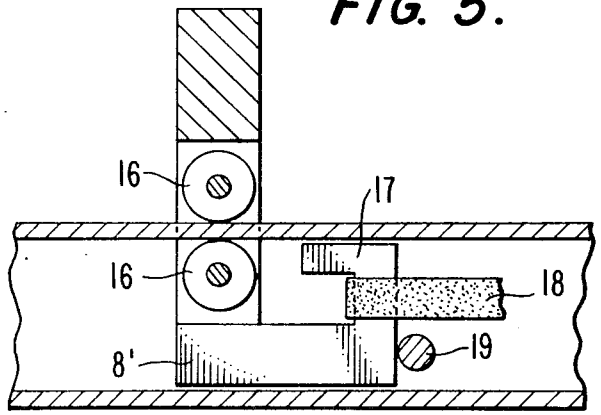
FIG. 5 is a side view of the foot braces with wheels for mounting the foot rests to the frame taken along the line V—V of FIG. 4.

According to another form of the invention, as shown in FIGS. 4 through 6, the foot braces have wheels 16 rotatably mounted on the bases 8 thereof for mounting the foot braces for rolling movement on the tubular member 3 of the leg conditioner. A hook 17 is formed on the lower, free end of each base 8 for securing the ends of an elastic member 18 extending between the foot braces within the tubular member 3. The elastic member can be formed of rubber or other suitable material for resiliently biasing the foot braces against movement away from one another. To prevent the foot braces from moving too close to one another in the guide slot 4, stop bolts 19 and 20 are provided which extend through the tubular member 3 to block the inward movement of the foot braces. Stop bolts could also be provided in the embodiment of FIGS. 1 through 3, if desired. Relatively wide stabilizer plates 21, 22 and 23 are also provided in the middle and at each end of the leg conditioner so as to extend in a direction at right angles to the longitudinal direction of the device. The handles 14 and 15 are secured to the plate 22 as shown in FIG. 6. Stabilizer plates as shown in FIG. 6 could be employed with the device of FIGS. 1 through 3.

The leg conditioner of FIGS. 4 through 6 and that of FIGS. 1 through 3 are used in a like manner by a person to perform leg split type exercises with the legs spread apart and the body in a position above the legs. The exercise begins by the person placing his/her feet on the respective foot braces, grasping the handles and thereafter forcing the feet outwardly to move the foot braces against the resilient bias of the springs or elastic member of the leg conditioner. The strength of the springs or elastic member can be selected so as to yield under the weight of the user to permit outward movement of the foot braces until the person attains a full or nearly full leg split exercising position. Alternatively, the strength of the springs or elastic member can be selected so that the person must exert significant force, in addition to his/her own weight, by the legs and/or by pulling downwardly on the handles in order to force the foot braces outwardly sufficiently to reach a full leg split exercise position. Of course, means could be provided on the device for permitting an adjustment of the biasing force to permit selection of either mode of operation. For example, the springs 12 and 13 and elastic member 18 could be adjustably preloaded. As the feet move the foot braces outwardly during the exercise, the user can, while grasping the handles, execute a forward and backward rocking motion to alternately relieve and increase stresses on the legs to aid in stretching the leg muscles, tendons and ligaments and thereby achieve the desired degree of leg flexibility and strength. In the full split position the legs are supported on the upper surface of the member 3 of the frame. The exercise is completed by simply moving the feet toward one another until the foot braces reach the stops as shown in FIG. 6 or the relaxed position of the compression springs in the case of the embodiment of FIGS. 1 through 3 whereupon the feet can be removed from the foot braces.

From the above, it can be seen that the invention offers the significant advantages of allowing a person to continuously and safely perform a leg split type exercise with the legs spread apart and the body in a generally upright position without fear of falling out of position. Injury and loss of time can thereby be avoided. Further, the combination of the handles in the intermediate portion of the frame and the resistance offered by the foot braces against outward movement allows a person to selectively increase the stress placed upon the legs during the exercise to thereby quantitatively control and enhance the conditioning and ultimate flexibility and strength of the legs. The handles also enable a significant rocking motion of the upper body to be achieved during the exercise for relieving and applying pressures to the legs whereby the conditioning can be further enhanced in a safe and efficient manner.

While I have shown and described only two embodiments in accordance with the present invention, It is understood that the same is not limited thereto, but is susceptible to numerous changes and modifications as known to those skilled in the art. For example, while the leg conditioner is shown in a form which simply rests on a floor or playing field, it could be elevated by the provision of legs or provided in a plane other than the horizontal plane, such as one inclined with respect to the floor or playing field. Also, leg split type exercises could be performed with the leg conditioner of the invention wherein only one of the two foot braces is movable and resiliently biased against outward movement to achieve the desired relative movement between the foot braces. Also, instead of biasing the foot braces with springs or an elastic member, it is envisioned that other means could be provided to yieldably resist the outward movement of the foot braces, such as controlled hydraulic fluid resistance as in a Nautilus type of exercise equipment. Therefore, I do not wish to be limited to the details shown and described herein, but intend to cover all such changes and modifications as are encompassed by the scope of the appended claims.

I claim:

1. A leg conditioner for use by a person performing a leg split type exercise with the legs spread apart and the body in a position above the legs comprising a frame, a pair of upstanding foot braces, means mounting said foot braces on said frame so that relative movement between said foot braces can be effected by a person performing said leg split type exercise with the fee pressed against the respective foot braces, said frame having a length sufficient to allow a person to spread the foot braces apart on the frame with the persons feet pressed against the respective foot braces during a leg exercise so that the person can attain a full or nearly full leg split exercising position, handle means arranged on said frame between said foot braces for said person to grip when performing said leg split type exercise, and means for yieldably resisting the spreading apart of the foot braces.

2. A leg conditioner according to claim 1, wherein said handle means comprises a pair of handles fixedly secured in spaced relationship on said leg conditioner on opposite sides of a line extending between said foot braces.

3. A leg conditioner according to claim 1, wherein said means mounting said foot braces on said frame includes wheels attached to said foot braces, said wheels cooperating with guides provided on said frame for movement of said foot braces on said frame.

4. A leg conditioner according to claim 1, wherein said means mounting said foot braces on said frame includes an elongated slot provided in an upper surface of said frame within which said foot braces are slidably mounted, said slot being relatively narrow so the legs can be supported on said upper surface of the frame adjacent said slot in the full split position.

5. A leg conditioner according to claim 1, wherein said frame is elongated and said foot braces are mounted on said frame for movement toward and away from one another in a direction along the length of said frame, and wherein the height of said handle means on said frame is only on the order of the height of the upstanding foot braces thereby facilitating gripping said handles for forward and backward rocking in the full or nearly full leg split comprising position.

6. A leg conditioner according to claim 1, wherein said means for resilient biasing comprises a pair of springs located between said frame and said foot braces respectively to bias the foot braces against movement away from one another.

7. A leg conditioner according to claim 1, wherein said means for resiliently biasing comprises a resilient member which extends between and is connected to said foot braces to bias said foot braces against movement away from one another.

8. A leg conditioner for use by a person peforming a leg split type exercise with the legs spread apart and the body in position above the legs comprising an elongated frame, a pair of upstanding foot braces, means mounting said foot braces on said frame so that said foot braces can be moved toward and away from one another by a person performing said leg split type exercise with the feet pressed against the respective foot braces, said elongated frame having a length sufficient to allow a person to spread the foot braces apart with the person's feet pressed against the foot braces during a leg exercise so that the person can attain a full or nearly full leg split exercise position, means for yieldably resisting the spreading apart movement of the foot braces, and handle means fixedly secured to said leg conditioner and located entirely in an intermediate portion of said elongated frame between said foot braces for said person to grip when performing said leg split type exercise whereby said person can safely attain and maintain said nearly full or full leg split exercise position and safely rock back and forth while performing said exercise.

* * * * *